US012704364B1

(12) United States Patent
Burke

(10) Patent No.: US 12,704,364 B1
(45) Date of Patent: Aug. 11, 2026

(54) BULLET PROJECTILE PRODUCING ELECTRO-MAGNETIC PULSE UPON IMPACT

(71) Applicant: Douglas Burke, Newport Beach, CA (US)

(72) Inventor: Douglas Burke, Newport Beach, CA (US)

( * ) Notice: Subject to any disclaimer, the term of this patent is extended or adjusted under 35 U.S.C. 154(b) by 0 days.

(21) Appl. No.: 16/602,383

(22) Filed: Sep. 25, 2019

Related U.S. Application Data

(63) Continuation-in-part of application No. 15/731,556, filed on Jun. 23, 2017, now Pat. No. 10,578,413.

(51) Int. Cl.

| | |
|---|---|
| ***F42C 11/04*** | (2006.01) |
| ***F42B 12/06*** | (2006.01) |
| ***F42C 11/00*** | (2006.01) |
| ***F42C 13/08*** | (2006.01) |

(52) U.S. Cl.
CPC ..... *F42C 11/04* (2013.01); *F42B 12/06* (2013.01); *F42C 11/008* (2013.01); *F42C 13/08* (2013.01)

(58) Field of Classification Search
CPC ..... F42B 12/02; F42B 12/04; F42B 12/06; F42B 12/20; F42B 12/204; F42B 12/207; F42B 12/34; F42B 12/74; F42C 11/04; F42C 13/08; F42C 19/0838; B21K 21/06; B21K 1/025
See application file for complete search history.

(56) References Cited

U.S. PATENT DOCUMENTS

| | | | | |
|---|---|---|---|---|
| 1,755,023 | A * | 4/1930 | Ruhlemann | F42C 11/00 102/209 |
| 3,699,889 | A * | 10/1972 | Cioccio | F42C 13/08 102/209 |
| 4,164,905 | A * | 8/1979 | Kohler | F42C 13/08 102/212 |
| 4,334,474 | A * | 6/1982 | Coltharp | F42C 19/12 102/202.5 |
| 4,417,518 | A * | 11/1983 | Siebert | F42C 9/148 102/212 |
| 5,450,805 | A * | 9/1995 | Beach | F42B 22/04 102/212 |
| 6,477,932 | B2 * | 11/2002 | Jung | F41H 13/0068 89/1.11 |
| 6,679,179 | B1 * | 1/2004 | Bohl | F41H 13/0093 102/210 |
| 6,845,718 | B2 * | 1/2005 | Fortner | F41B 6/006 102/489 |
| 9,279,645 | B2 * | 3/2016 | Schlenter | F42C 11/008 |
| 10,415,937 | B2 * | 9/2019 | Graswald | F42C 19/0838 |
| 2011/0203476 | A1 * | 8/2011 | Smogitel | F42B 12/36 102/501 |

FOREIGN PATENT DOCUMENTS

| | | | | |
|---|---|---|---|---|
| GB | 283585 | A * | 8/1928 | F42C 11/00 |

* cited by examiner

*Primary Examiner* — Joshua T Semick

(57) ABSTRACT

A Bullet Projectile system is described wherein a bullet with an internal sliding magnetic hammer moves through an internal cylindrical coil upon impact thereby generating an Electro-Magnetic pulse which moves into and through target to the benefit of causing damage to electronic devices within said target.

17 Claims, 8 Drawing Sheets

BULLET PROJECTILE PRODUCING ELECTRO-MAGNETIC PULSE UPON IMPACT

BACKGROUND OF THE INVENTION

The proposed invention is in the field of bullets and projectiles for warfare. In its basic mode it is related to double impact bullet systems. This is a formal application and is a continuation in part of U.S. patent application Ser. Nos. 15/731,556 and 15/731,555. This is a continuation of the inventor's earlier cited applications and contains new matter which in the present invention allows the double impact bullet to produce an electromagnetic pulse upon impact with the target with the goal of creating damage to the structures and functions of computers and other electronic systems which may be inside said target. This novel new mode of inventor's earlier disclosed double impact system is required like the earlier application to address the double impact systems in the prior art. Some of this is the same as the prior art sections of U.S. application Ser. No. 15/731,556.

In the prior art a good description for a modern exploding bullet is given on Wikipedia and that example is used here with a different description than is on Wikipedia. Nonetheless the basic elements of the prior art can be taught and explained with this example. One can find all of this by searching the words High explosive incendiary armor piercing ammunition on Wikipedia.)

High-explosive incendiary/armor-piercing ammunition (HEIAP) is a form of shell which combines armor-piercing capability and a high-explosive effect. In this respect, it is a modern version of an armor-piercing shell.

Typical of a modern HEIAP shell is the Raufoss Mk 211 .50 BMG round designed for weapons such as heavy machine guns and anti-materiel rifles. It is as good an example to use as any other since all these exploding bullets have the same basic elements. It is ahown FIG. 1.

The Raufoss Mk 211 is a .50 caliber (12.7×99 mm NATO) multipurpose anti-matériel projectile produced by Nammo (Nordic Ammunition Group, a Norwegian/Finnish military industry manufacturer of ammunition), under the model name NM140 MP. It is commonly referred to as simply multipurpose or Raufoss, which refers to Nammo's original parent company: Raufoss Ammunisjons fabrikker (Ammunition Factory) in Raufoss, Norway, established in 1896. The "Mk 211" name comes from the nomenclature "Mk 211 Mod 0" used by the U.S. military for this round.

Due to its popularity, several U.S. arms manufacturers produce the round under license from NAMMO Raufoss AS. There is also a tracer variant, the MK300, used in the Browning heavy machine gun.

The primary purpose of these munitions is armor penetration, HEIAP munitions use high explosives to "blast a path" for the penetrator. Referring to FIG. 1, within the copper jacket there are several parts which communicate mechanically and chemically upon impact. As the bullet hits the target the target offers resistance in the form of friction upon deceleration. The friction between the bullet and the object it hits causes the incendiary material in the nose of the bullet to ignite which in turn ignites the high explosive material. The high explosive material can be HMX, RX51-PETN, RDX COMP A-4, or any of the plastic explosives which have the chemistry to internally explode without the need for an external oxygen source. When the high explosive material explodes, the explosion is supposed to blast a path for the tungsten carbide penetrator which then can continue on through the material out of which the target is made. The zirconium powder is an additional material that continues to burn after the explosion perhaps to cause damage to flesh and bone etc . . . . The MK 211 is claimed to penetrate up to two inches (51 mm) of rolled homogeneous armor.

The triggering of the explosive charge is dependent upon the resistance of the target. If the target offers little resistance then the lack of frictional heating will prevent the incendiary from igniting and the high explosive from detonating.

Considerimg FIG. 2 an early version of an exploding bullet to Holmblad 8 Aug. 1900 U.S. Pat. No. 726,291. This has initial impact upon collision and secondary shock waves due to its explosion. An even earlier version of a multiple impact bullet would be the tethered musket balls or cannon balls referred to in FIG. 3 These were used to impart damage to ships rigging and masts.

These exploding bullets are mentioned because they have a double impact quality. The present proposed invention does not explode upon impact. It does however have a double impact feature.

The proposed invention is a novel double impact bullet with an internal magnetic hammer which in addition to delivering a mechanical kinetic phenomenon superior to previous double or multiple impact systems, it also generates an electro-magnetic pulse which moves into the depth of the target. Having an internal sliding magnet, the invention further includes a concentric cylindrical coil the ends of which are generated a high voltage spark discharge that creates the electro-magnetic pulse. The internal magnetic hammer kinetic action of the proposed invention within the body of the bullet is absent in the prior art and is the reason for the advantages of the proposed invention. Further the internal electromagnetic induction features of the proposed invention further describe the novelty of this invention.

A specific example from physics will describe some background terms which will aid in the description of the invention. A wire wound in a cylindrical coil has an electrical property called inductance. The inductance of the coil is the magnetic permeability of the material within the coil times the number of turns squared times the cross-sectional area of the coil divided by the length of the coil. If a permanent magnet is moved into the coil the magnetic flux through the inside of the coil will change with time and a voltage will appear across the two ends of the wire and a current will appear in the wire. The electro-magnetic energy stored in the inductor when there is a voltage between the ends of the wire is equal to one half times the inductance times the square of the current.

Throughout the specification language will be used in the description of materials. Words like a stiff material with a high Young's modulus will be used. The word "Hard" in describing a material will also be used. So, the stiffness of a material and the hardness of a material need to be defined clearly.

The Young's modulus is like the spring constant of the material, but it also has the same units as the hardness that is units of pressure. Imagine that you have a cylinder of a material and you apply a force F along the axis of the cylinder to try and stretch it and make it longer. The cylinder would have a cross sectional area A. The force per area on the material is F/A and has the units of pressure. As the force is applied along the axis of the cylinder the material will undergo a change in length which we can call $\delta L$. The original length before the force was applied we will call $L_o$. As the force is applied the following equation is obeyed $F/A=Y(\delta L/L_o)$. This equation defines the Young's modulus Y. The term F/A has units of force per area which is Newtons per meters-squared which are also Pascals. For purposes of description a material that is stiffer than another material means that the stiffer material has a higher Young's modulus.

Another important property of materials that relates to the proposed invention is the hardness of a material. As a pressure is applied to a material the material deforms and as the pressure is released the material springs back to its original shape. As the pressure applied is increased, eventually the material will not spring back and remains deformed. It undergoes plastic deformation. The maximum pressure the material can withstand before it undergoes plastic deformation is called the hardness. Another way of stating this is that the hardness of a material is measured as the force per area that the surface can withstand before it suffers a minimum indentation. Hardness therefore has the same units as Young's modulus. Those units are pressure. Pressure is Newtons per square meter which are also called Pascals. A Giga-Pascal is written GPa and is a billion Pascals or $10^9$ Pascals. A Mega-Pascal is written MPa and is a million Pascals or $10^6$ Pascals.

The Young's modulus of a typical ceramic like Alumina is around 360 GPa. Silicon Carbide has a young's modulus of 440 Gpa. The Young's modulus of Beryllium is between 275 and 315 Gpa depending on how it is annealed. The Young's modulus of a typical Spring Steel like ASTM A227 spring steel is around 190 Gpa. The hardness of ceramics ranges from 10 to 50 Gpa which is equivalent to between 10,000 and 50,000 Mpa. The Young's Modulus of Copper is between 121 and 133 Gpa depending on how it is annealed. The Young's Modulus of lead is between 13 and 15 Gpa depending on how it is annealed.

The Young's modulus of Uranium is between 174 and 178 Gpa depending on how it is annealed. The hardness of Uranium is between 1850 and 2750 Mpa depending on how it is annealed. The density of Tungsten is 19.25 g/cm3. The Young's modulus of Tungsten is between 340 and 405 Gpa depending on how it is annealed. The hardness of Tungsten is between 4500 and 8500 Mpa depending on how it is annealed.

OBJECTS AND ADVANTAGES (1) The proposed invention is an improved double impact bullet that produces an electro-magnetic pulse (EMP) upon impact.

(2) The proposed invention only requires deceleration to produce the EMP. It does not require a high friction impact with target to produce the EMP.

(3) The proposed invention does not require an incendiary load. The space not used up for the incendiary material can be used to increase the amount field strength of the EMP.

(4) In addition to generating an EMP the proposed invention can be used to generate a spherical shock wave of extremely high pressure to further the damage to armor beyond what was previously possible to provide a hole in said armor through which the EMP can penetrate.

(5) The proposed invention does not require an internal electric power source.

(6) The proposed invention will not produce an EMP when it is fired thus the user is not in danger of an EMP.

(7) In some of the modes of the proposed invention an EMP is generated where the leading edge is a magnetic field that changes direction abruptly with time allowing for effective penetrating power of the EMP through the target walls

DETAILED DESCRIPTION OF THE INVENTION

The invention has many modes and they will be described in an order that teaches the reader the essence of the technology. In all the modes of the proposed invention it is assumed that the reader is skilled in the art and that it is obvious how to get the projectile into flight from an explosive gun powder or its equivalent in a firearm. It is also assumed that a full metal copper jacket would cover each of the structures shown in all of the modes of the invention. The full metal copper jacket is left out of the description and is absent from the drawings. Terminology from rocketry science is used since it seems like the terms are a natural way to describe the technology. These terms are specific to the proposed invention and their meanings are not identical to the way they are used in rocketry but they are however close. For example, a nose cone in rocketry is a separate and distinct embodiment from the fuselage but for the proposed invention they may be considered a single embodiment depending on whether they are made of different materials.

It is further noted that there is a co-pending application filed on the same day as this application which is a strictly mechanical projectile with internal electromagnetic induction being absent. The description of the content of that specification is repeated here because the details in that description are necessary background for understanding the present invention.

Figure 4:
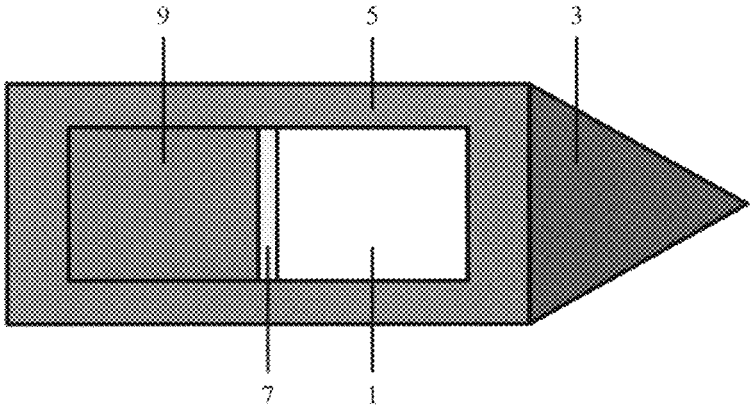
FIG. 4 Projectile with fundamental mechanical features shown and pointed nose cone FIG. 5 Projectile with fundamental mechanical features shown and rounded nose cone FIG. 6 Projectile with fundamental mechanical features shown and flat tipped nose cone FIG. 7 Projectile with mechanical and electro-magnetic features shown and pointed nose cone FIG. 8 Schematic showing magnetic field flux lines from magnetic hammer motion entering coil region FIG. 9 Design with coil wire ends shorted to each other within fuselage by way of a dashed line FIG. 10 Design showing spark gap capacitor with one pointed electrode and one flat electrode FIG. 11 Design showing spark gap capacitor with both electrodes pointed FIG. 12 Design with additional isolated region within fuselage containing magnetic shot material and or magnetic shrapnel material FIG. 13 Design with and isolated region of magnetic shot or shrapnel FIG. 14 Design with coil region of shorter length to change shape of emitted pulse FIG. 15 Shape of magnetic pulse generated upon impact in some of the modes described FIG. 16 Schematic of induction circuit with diodes included

Referring to FIG. 4 what is shown are the basic embodiments of the proposed invention. This mode is claimed in a co-pending application and its description is repeated here to make the electromechanical action of the present invention easier to understand. Again, referring to FIG. 4 this mode consists of an empty internal space (1), a nose cone (3), a fuselage (5), a Hammer retaining mass spacer (7), and an internal Hammer (9). The hammer is inherently internal and will be referred to as the hammer without further use of the adjective internal. The operation of this mode comprises the following. After the bullet is in flight it will fly towards its target. Upon impact with the target the nose cone and fuselage will experience a shock wave of first mechanical impact. Because of Newton's second law, due to the deceleration of the center of mass of the system the hammer will be forced forward towards the nose cone. As the hammer is forced forward the hammer retaining spacer is designed to break and allow the hammer to move forward within the fuselage. Alternatively, the hammer could be tethered to the rear of the fuselage. The tether would be a string which would break upon impact as the hammer is forced forward. The nose cone can be made large enough and massive enough to allow the hammer enough time to move through the fuselage before the fuselage suffered fracture which would immobilize the hammer. That is to say that upon first impact the nose cone would be designed to undergo a plastic deformation that would absorb the initial shock wave thereby protecting the fuselage from damage giving the hammer enough time to move through the interior of the fuselage. The hammer would thus be forced through the nose cone and into the target providing a secondary impact to the target. It is desirable that the hammer have more mass than the mass of the sum of the remaining parts. To achieve this end the nose cone would be made out of lead. The fuselage would be made from ceramic. The hammer would be made from Uranium. Depleted uranium would be fine since there is no advantage to it being not depleted. These choices of materials would allow the bullet to function upon impact. The desired mechanical effects are that the initial blow causes plastic deformation in the nose cone. The first shock wave is thus slowed down by the plastic deformation. The hammer is forced forward in the rigid structure of the fuselage. The hammer makes the secondary impact with the target. This mode of the proposed invention is thus a double impact bullet. The first impact serves to soften the target by way of kinetic energy being converted into heat. The second impact of the hammer serves to deliver the penetrating blow to the target. As will be made clear later in the proposed invention the hammer will be an alloy that will be of a dense material but will also have a permanent magnetic moment. The reasons for this are part of the novelty of the proposed invention.

The hammer itself is a solid cylinder. Like all solid cylinders it has a length and a diameter. The hammer has specific mechanical communication with the fuselage. The length of the hammer is an important parameter and such we shall refer to its length at times as $L_H$. The L indicating length and the subscript H indicating hammer. The fuselage is also a cylinder. It is different from the hammer in that it is not a solid cylinder. The fuselage is a hollow cylinder. Therefore it has walls with a defined thickness. The perpendicular cross section of all hollow cylinders defines two concentric circles. The inner circle has a diameter which we shall refer to as the inner diameter. The outer circle has a diameter which we shall refer to as the outer diameter. The wall thickness of all hollow cylinders is one half of the outer diameter minus one half of the inner diameter. The fuselage in this invention is indeed a hollow cylinder an it has a length. The length of the fuselage is an important parameter and such we shall refer to its length at times as (LF). The L indicating length and the subscript F indicating fuselage. Furthermore, the fuselage is a hollow cylinder and so has an inner diameter and an outer diameter. In describing this invention and in the language of the claims we may refer to the inner diameter of the fuselage as (ID) and the outer diameter of the fuselage as (OD). Since the hammer has to slide within said fuselage and the fuselage has closed ends it is obvious by conservation of space that the length of the hammer must be less than the length of said fuselage. In the notation now defined this can also be worded with phrases like "the hammer having a length less than (LF)" which will have the meaning that the length of the hammer is less than the length of the fuselage as it must be if it is to be able to move within the hollow enclosure defined by the fuselage which is a hollow cylinder. It should also be noted that the hammer will slide within the fuselage and so must have a diameter that is less than the (ID) of the fuselage. How much less is determined by the standard machining practices as defined in the machining handbooks. For the purposes of the invention the diameter of the hammer should be between one and 10 mils than the inner annulus of fuselage in which it is designed to slide. A mil being a thousandth of an inch.

Figure 1:
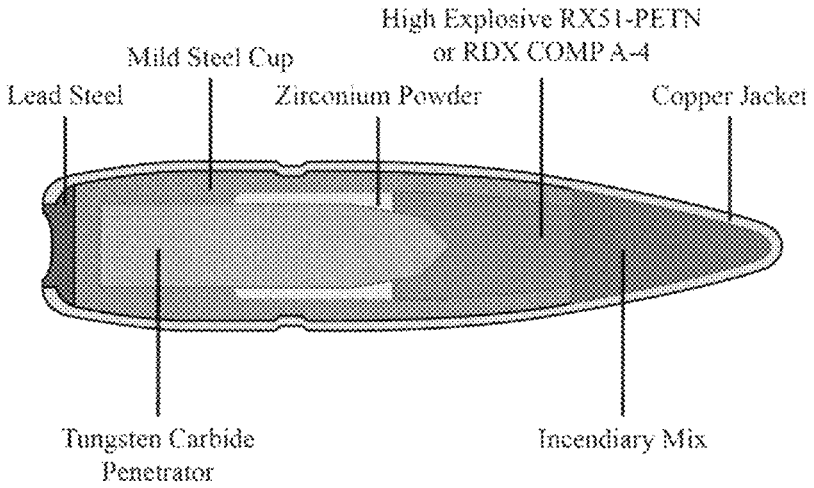
Figure-1 (Prior Art)
FIG. 1 Modern exploding double impact bullet design with penetrator
Figure 2:
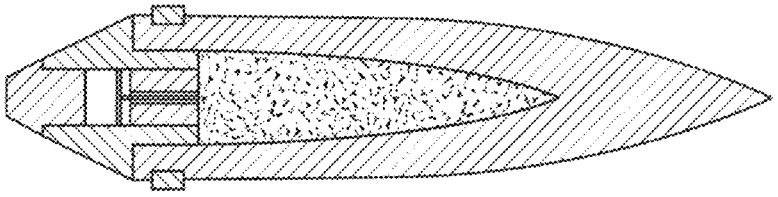
Figure-2 (Prior Art)
FIG. 2 Exploding bullet of Holmblad from 1900
Figure 3:
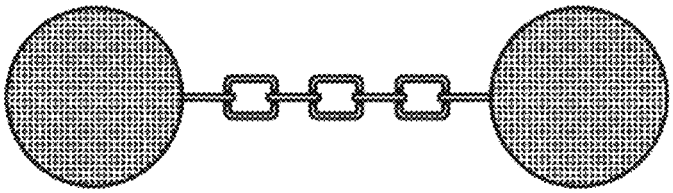
Figure-3 (Prior Art)
FIG. 3 Tethered musket balls for double impact
Figure 5:
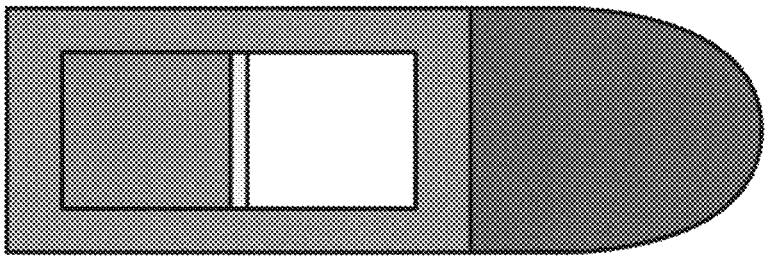

Referring to FIG. 5 what is shown is another version of the mechanical mode of the invention with all the same basic elements as those found in FIG. 1. The only difference is that there is a geometric difference in the design of the nose cone. Thus, all the adjustments in shape that are made in bullets in general can be made to the bullet projectiles of the proposed invention. Here the nose cone is shown to be rounded.

Figure 6:
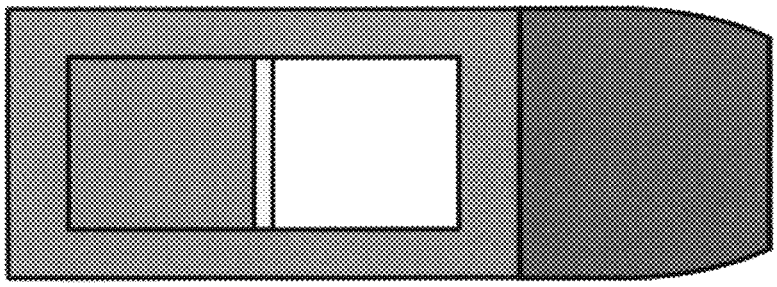

Referring to FIG. 6 what is shown is another version of the mechanical mode of the invention with all the same basic elements as those found in FIG. 4. The only difference is that there is a geometric difference in the design of the nose cone. The advantage to this design of mode one of the proposed invention is that it is less likely to ricochet off the target before the hammer engages. The hammer is Uranium and it is not involved in the first impact directly. The nose cone is made of lead which has a relatively low specific heat. The leading geometry of the nose is flat so the bullet is not designed to penetrate. The nose cone will however get relatively hot on impact and deform around the sides of the fuselage. This will spread kinetic energy around the fuselage and protect it from getting damaged so there is time for the hammer to move inside the fuselage and deliver the secondary impact. If the fuselage gets damaged before the hammer slides forward the effectiveness of the hammer will be limited.

A choice of materials would be for the fuselage to be made of ceramic or a very stiff metal like Beryllium or spring steel. These materials are known to be stiff which means they have a high Young's modulus. The Young's modulus of a typical ceramic like Alumina is around 360 GPa. Silicon Carbide has a young's modulus of 440 Gpa. The Young's modulus of Beryllium is between 275 and 315 Gpa depending on how it is annealed. The Young's modulus of a typical Spring Steel like ASTM A227 spring steel is around 190 Gpa. The hardness of ceramics ranges from 10 to 50 Gpa which is equivalent to between 10,000 and 50,000 Mpa. The nose cone should be made of copper or lead. The Young's Modulus of Copper is between 121 and 133 Gpa depending on how it is annealed. The Young's Modulus of lead is between 13 and 15 Gpa depending on how it is annealed. The Hammer should ideally be made of Uranium or Tungsten or a high-density alloy. However as will be shown the hammer in the operational form specific to the proposed invention needs to be a material which has a permanent magnetization. This means it needs to be ferromagnetic. So the hammer will be an alloy of a high density metal combined with a permanent magnetic material like Iron or Nickel or Neodymium or some combination thereof. The density of Uranium 19 g/cm$^3$. The Young's modulus of Uranium is between 174 and 178 Gpa depending on how it is annealed. The hardness of Uranium is between 1850 and 2750 Mpa depending on how it is annealed. The density of Tungsten is 19.25 g/cm3. The Young's modulus of Tungsten is between 340 and 405 Gpa depending on how it is annealed. The hardness of Tungsten is between 4500 and 8500 Mpa depending on how it is annealed. The hardness of a material is measured as the force per area that the surface can withstand before it suffers a minimum indentation.

In general, the fuselage should be made of a hard material with a high Young's modulus and a high hardness. The nose cone should be made of a material that is softer than the fuselage. The Hammer should be made of a high-density alloy that has ferromagnetic properties which play a part in the operational novelty of the invention.

The fully operational mode which is the mode claimed in the proposed invention that is to follow is the electromagnetic electromechanical mode that produces an electromagnetic pulse (EMP). All the features discussed above can be incorporated into the design of the electromagnetic electromechanical mode that produces an EMP.

Figure 7:
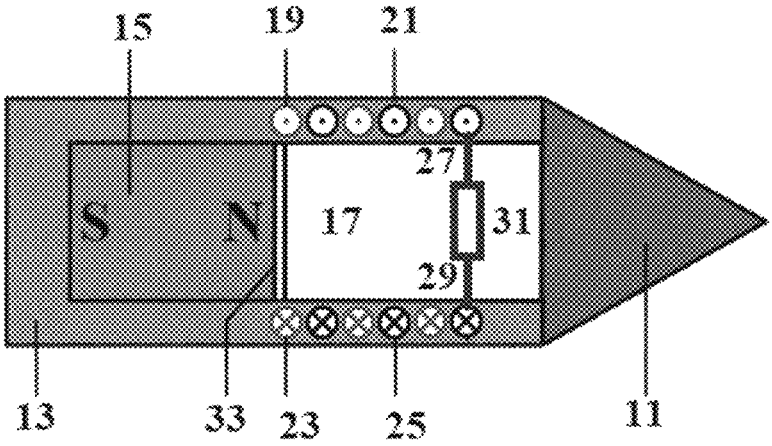

The electromagnetic electromechanical mode of the proposed invention is a novel design of a bullet that explodes on impact. Referring to FIG. 7 what is shown are the basic embodiments of this operational mode of the proposed invention. It consists of a nose cone (11), a fuselage (13), an internal Hammer made of a material which has a permanent aligned magnetic moment with north pole marked N and south pole marked S (15), a region of empty space (17), a wire or conductive path embedded within the cylindrical fuselage and wrapped with cylindrical symmetry surrounding the region packed with explosive material (19), (21), (23), (25) as the wire moves in a contiguous path in a circle around the cylindrical fuselage that portion of the wire that would move out of and into the plane of the page as represented by (19) & (21) which are symbolic representations of a tip of an arrow pointing out of the plane of the page, as the wire moves in a contiguous path in a circle around the cylindrical fuselage that portion of the wire that would move into the plane of the page is represented by (23) & (25) which are symbolic representations of a tail of an arrow pointing into the plane of the page, and one end of said cylindrical wire or conductive path terminating into a first side (27), of an antennae (31), in said region of empty space (17), the opposite remaining end of said cylindrical wire or conductive path terminating into a second side (29), of an antennae (31), in said region of empty space (17), said two opposing ends of wire terminating into opposing end of said antennae (31), and said antennae being an electrical resistor whose resistance is greater than the resistance of the wire or conductive path comprising said coil. Referring to FIG. 7, as said wire wraps around within the annulus of said fuselage that portion of the wire that is traversing from right to left is color coded in black (21) & (25), and that portion of the wire that is traversing from left to right is color coded in blue (19) & (23). Further included is a spacer (23), which holds said hammer in place to the rear of the said fuselage. Said spacer is designed out of thin plastic or glass and is designed to break when bullet strikes a target allowing said hammer to slide forward. Said spacer could just as well be made of wax or anything that would hold hammer in place until impact.

Figure 8:
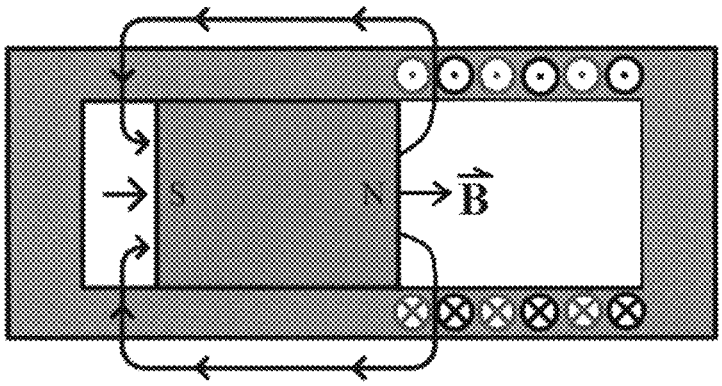

The operation of the proposed invention is explained as follows. Upon impact with the target the bullet system decelerates, and the internal Hammer is forced forward into the region of empty space. Referring to FIG. 8 what is shown is the magnetic polarity of the Hammer, said Hammer being a permanent magnet in the requirements cited above. As can be seen in FIG. 8 the right side of the Hammer is labeled with an N indicating the north pole of its magnetic moment and the left side of the Hammer is labeled with an S indicating the south pole of its magnetic moment. The magnetic field lines, B, of the Hammer emanate from the North Pole and wrap around into the South Pole as shown in FIG. 5. Thus, as the Hammer moves into the region of empty space it is creating a time changing magnetic flux through the geometric interior of the cylindrical coil. This time changing magnetic flux will induce a voltage between the wire or conductive path termination points (27) & (29) in FIG. 12 which feed into the antennae (27), according to Faraday's Law of electromagnetic induction. This voltage across the antennae will produce the EMP which moves forward into the target. The sudden impact of the bullet will force the Hammer Magnet through the coil in less than a millisecond making the time derivative of the Magnetic Flux very large. If the Hammer is made of 80 percent depleted Uranium and 20 percent Neodymium-Nickel-Boron (a permanent magnetic material with a large magnetic moment per unit volume) the voltage between the wire termination points (27) & (29) in FIG. 7 and consequently across said antennae (31), can be made to be well into the several kilovolt range with a modest number of turns on the coil. This will create an effective EMP. Thus, the action of the Hammer moving through the coil acts as a generator for the EMP. The actual voltage generated between the wire termination points (27) & (29) in FIG. 7 is proportional to the number of turns in the coil n times the cross sectional area of the coil A times the derivative of the magnetic field with respect time, $\delta B/\delta T$, within the coil. The number of turns n can be adjusted to accommodate needs of high voltage. The geometry of the nose cone and the choice of material of the nose cone can make the bullet stop very quickly in the target making the derivative of the magnetic field with respect time within the coil larger or smaller (by way of adjusting $\delta T$) to allow another method of adjusting the voltage output at the wire termination ends to accommodate needs of high voltage. The magnetic moment per unit volume within the material of the Hammer can be adjusted by choice of materials out of which the Hammer is made. This makes the actual magnetic field of the Hammer just beyond its ends larger or smaller. This allow another method of adjusting the voltage output at the wire termination end to accommodate needs of high voltage (by way of adjusting $\delta B$). The EMP producing bullet system of the proposed invention has the advantage that it can be delivered by a soldier with a conventional rifle. The EMP is implanted mainly on the target alone.

Figure 9:
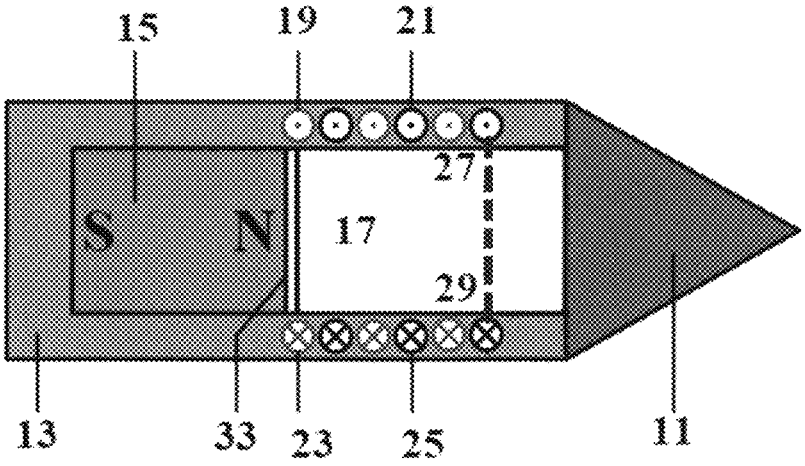
Figure 15:
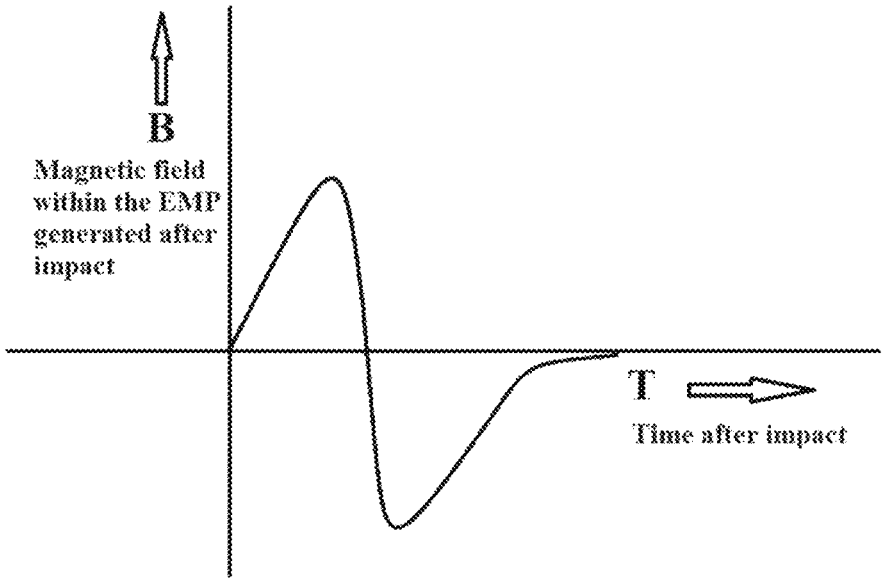

Another version of the proposed EMP producing bullet system is shown in FIG. 9. All of the embodiments are the same as in FIG. 7 with the exception of the antenna. The antenna being absent. Instead the ends of the wires or conductive paths of said coil (27) & (29) are connected or shorted to each other within the body of said fuselage. Referring to the FIG. 9 the ends of the wires of the coil or conductive paths (27) & (29) are connected by a dashed line where the antennae was in FIG. 7. This is just a symbolic representation of them being connected to each other within the body of said fuselage. This mode of the invention has a tremendous advantage. When said hammer moves forward upon impact it induces a current through said coil which produces a magnetic pulse. The primary field generated at impact is a magnetic pulse. Now as time progresses that magnetic pulse because it is changing with time will produce electric field and an electromagnetic field will evolve with time. Still the primary field that is perpendicular to the target will be a magnetic pulse. Most targets will be made out of metals like steel. These metals being electrical conductors serve as good shielding for electric fields. They do not shield magnetic fields. Therefore, this mode of the invention is capable of sending a primary magnetic pulse into the interior of said target without having to also simultaneously blow a hole in said target. A bullet with a flat nose cone designed to stop at the target surface can produce a magnetic pulse that will go right through the target walls and within those walls cause destructive damage to the electronics therein. This mode is unobvious in that the conventional thinking is that when the magnetic hammer moves into said coil that the field electric generated in the coil will be in in a circular direction tangent to the coil circular windings and that electric will drive current in the coil that will produce an induced magnetic field in the opposite direction of the field imposed in the coil by the motion of the magnetic hammer. They are correct since that is exactly what will happen according to Faraday's law. Then the conventional wisdom would say okay then the induced field is going to cancel or nearly cancel the field of the incoming magnetic hammer and there will be little or no EMP generated. That is not correct. The incoming magnetic field from the magnetic hammer and the magnetic field induced by the coil will be out of phase. That means that there will be a very short time lag between them. This will create an EMP with the direction of the leading edge of the magnetic field pointing one way at the instant of impact and then a very short time later the direction of the magnetic field flips in the opposite direction. This quick magnetic field flip will have superior penetrating power through the wall of a target and be able to get into the interior of said target easily where it can cause damage to computers and electronics inside said target. Referring to FIG. 15 what is shown is a graphical schematic of the magnetic field that enters the target wall as a function of time after impact. The shape of this double pulse is what has just been described with words. As will be shown in a later mode there is another way to achieve this and so FIG. 15 will be referred to again later.

Figure 10:
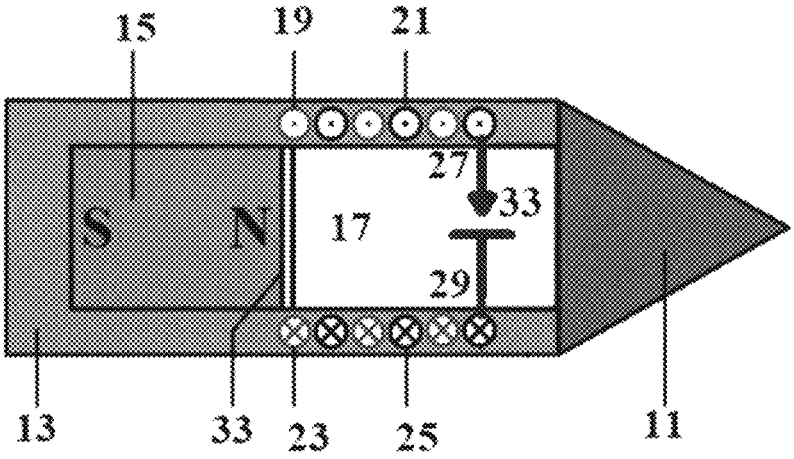

Another version of the proposed EMP producing bullet system is shown in FIG. 10. All the embodiments are the same as in FIG. 7 with the exception of the antenna. The antenna being absent. Instead the ends of the wires or conductive paths of said coil (27) & (29) terminate into a spark gap capacitor (33). Referring to the FIG. 10 the top wire (27) terminates into a sharp point and the bottom wire (29) terminates into a plate. In this mode of the invention when said hammer moves forward upon impact it produces a high voltage between the ends of said coil wires (27) & (29) which produces spark discharge across the spark discharge capacitor. This spark discharge produces the EMP that flows into the target.

Figure 11:
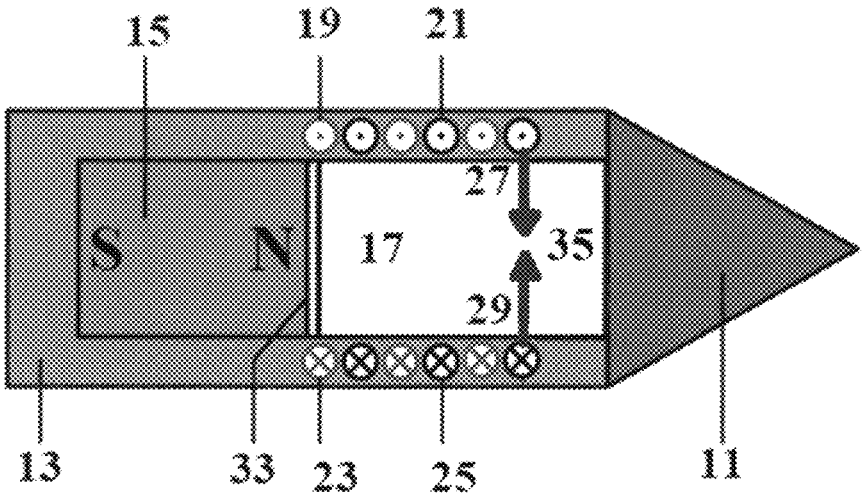

Another version of the proposed EMP producing bullet system is shown in FIG. 11. All the embodiments are the same as in FIG. 7 except for the antenna. The antennae being absent. Instead the ends of the wires or conductive paths of said coil (27) & (29) terminate into a spark gap capacitor (35). Referring to the FIG. 11 the top wire (27) terminates into a sharp point and the bottom wire (29) terminates into a similar sharp point. In this mode of the invention when said hammer moves forward upon impact it produces a high voltage between the ends of said coil wires (27) & (29) which produces spark discharge across the spark discharge capacitor. This spark discharge produces the EMP that flows into the target. With both sides of the capacitor being sharp points instead of one side being a plate the spark discharge will begin sooner after impact.

Figure 12:
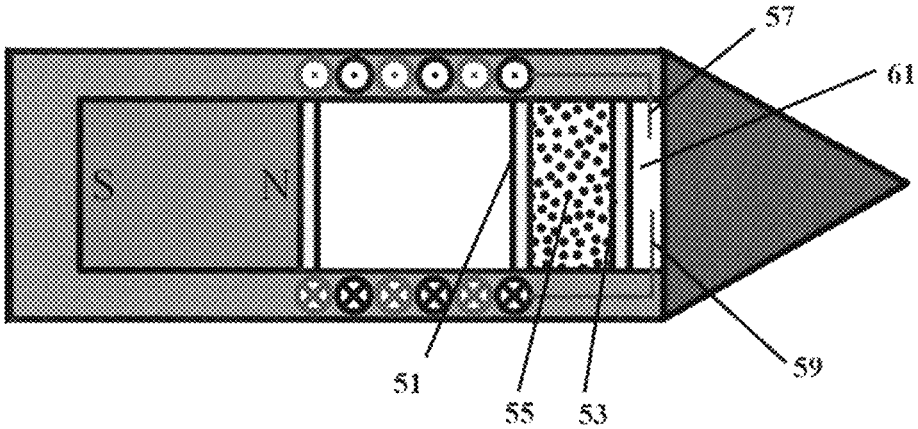
Figure 13:
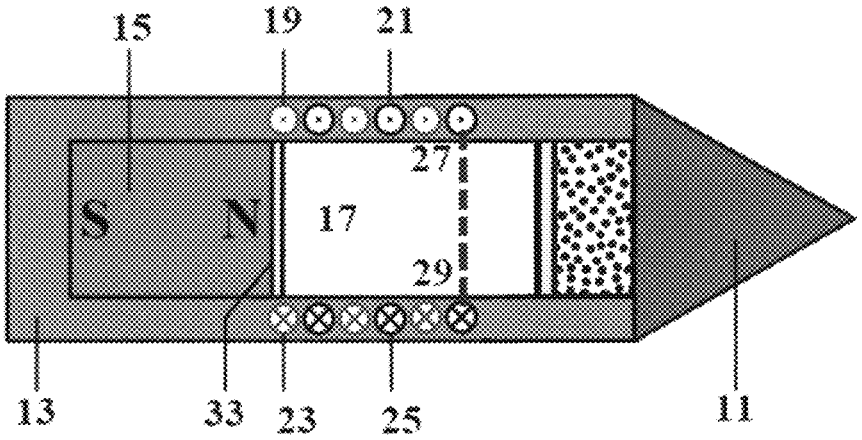

Another version of the proposed EMP producing bullet system is shown in FIG. 12. This mode has all the elements of FIG. 7 with some additional features. Referring to FIG. 12 there are two more spacers (51) and (53) which create two more isolated regions (55) and (61). In region (61) the ends of the coil wires (57) and (59) terminate into one of the earlier configurations described in FIGS. 8, 9, 10, 11. In region (55) there is shot or shrapnel of a specific material. You can think of it as like the shot fragments in a shotgun shell. Said shot or shrapnel is composed of a ferromagnetic material. In this mode when said bullet strikes a target the magnetic shot accelerates into said target. Each piece of shot becomes a small dipole antennae which generates its own electromagnetic pulse forward. The size of shot can be sub millimeter on up to $1/16^{th}$ of an inch in diameter Another version of the proposed EMP producing bullet system is shown in FIG. 13. This mode has all the elements of FIG. 9 with one modification. There is an additional isolated region within said fuselage and between said nose cone and the front of said coli containing magnetic shrapnel or shot. Like the design of FIG. 9 this design has ends of said coil shorted within the body of said fuselage. As the magnetic hammer moves forward the leading pulse is magnetic. The magnetic shot or shrapnel further enhances the magnetic pulse.

Figure 14:
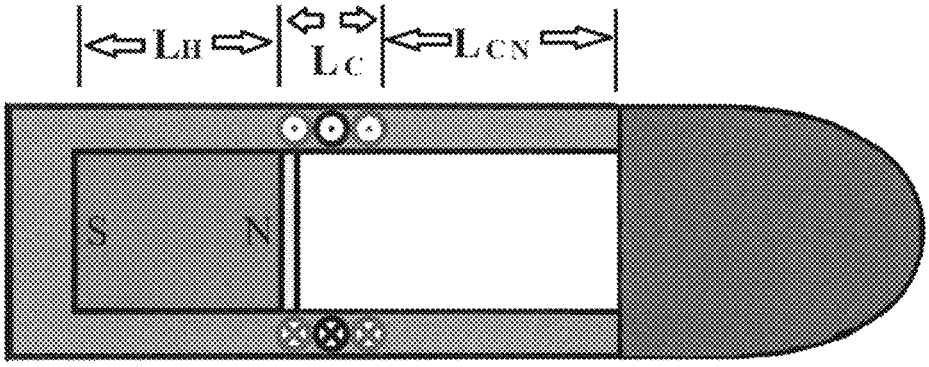

All of the designs can incorporate an additional feature wherein said magnetic hammer has a length, $L_H$, which is of specific magnitude in relation to the other embodiments within said bullet system. Referring to FIG. 14 one can see a schematic showing these relationships. Again referring to the FIG. 14 what is shown are the dimensions of the length of the hammer $L_H$, the length of the coil $L_C$, and the length of the distance from the front of the coil to the base of the nose cone $L_{CN}$. With this feature of constraints on result effective parameters the shape of the magnetic field within the electromagnetic pulse generated upon impact more closely resembles the graph shown in FIG. 15. The shape of this pulse is specific in that there is a point of inflection in the curve of the magnetic field generated as a function of time. A point of inflection is a where the second derivative of the magnetic field as a function of time is zero within the time where the magnetic field is relevant. This condition on the shape of the pulse of the magnetic field is a magnetic pulse that can more effectively penetrate into a target and is also more effective at damaging the electronics within said target. A magnetic pulse with a shape as defined in FIG. 15 can pass through metal most effectively.

A general discussion of the electromagnetic theory of operation of the proposed bullet system gives rise to novel circuit features that are critical to the successful operation of the invention. These features are now discussed.

Figure 16:
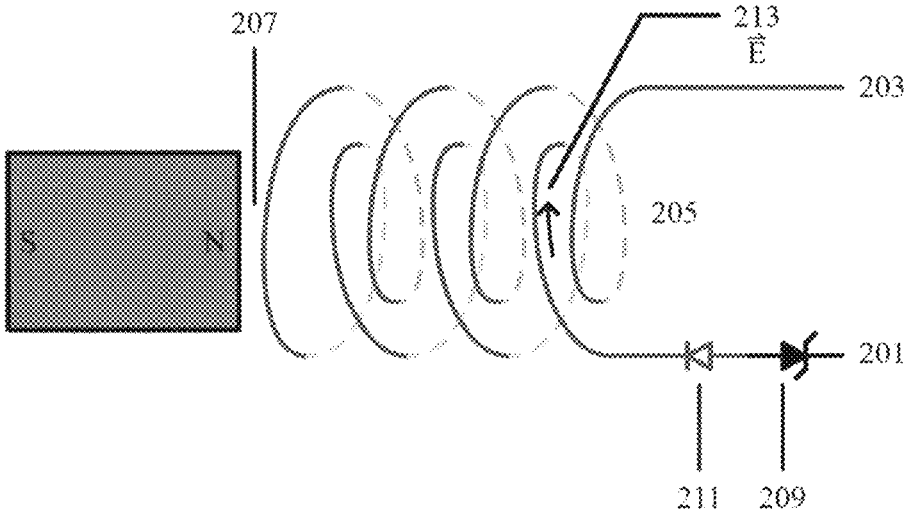

A precautionary additional feature can be added to all modes of the invention. Referring to FIG. 16, imagine that the coil in FIG. 16 is the coil in the bullet system and the bullet system is travelling from left to right in the diagram. As the bullet strikes the target on the right-hand side of FIG. 16 the Magnet Hammer moves into the coil from left to right entering the coil at position (207) in FIG. 16. In FIG. 16 the blue shaded part of the coil is traversing from right to left in the figure, and the red shaded part of the coil is traversing from left to right in the figure. The dotted or dashed lines in the coil are behind the solid lines. Bearing this in mind if you look down the axis of the coil from position (205) in FIG.

16 you are looking from right towards the left in the Figure. So, in FIG. 16 in looking down the axis of the coil through the coil from the point of view of position (205) the coil winding has a clockwise sense as you travel from position (201) to position (203). As the bullet system which is moving from left to right in FIG. 13 strikes a target the Hammer will be accelerated to the right with respect to the coil and enter the coil at position (207). With the right side of the Hammer being the magnetic north pole of the Hammer magnet the magnetic flux through the coil will be increasing with a sense of left to right in FIG. 16. Faraday's Law will cause an electric field (213) to be created which will have a clockwise sense if you look down the axis of the coil from position (205). The negative of the path integral of the electric field (213) from position (201) to position (203) is equal to the voltage at position (203) minus the voltage at position (201). Since the electric field and the path sense of the integral both have the same direction when looking down the axis of the coil from position (205) the voltage at position (201) will be higher than the voltage at position (203). This is the induced EMF caused from Faraday's Law as the Hammer Magnet moves into the coil. The diode (211) in FIG. 16 allows this EMF to develop because with respect to the induced electric field (213) the diode (211) is forward biased and represents a short circuit across its terminals. The Zener diode (209) in FIG. 16 however is reversed biased with respect to the electric field (213). The Zener diode (209) however will not have any effect because it will be chosen to have a reverse bias breakdown voltage of say 100-200 volts. The voltage developed between position (201) and (203) will be much higher than this Zener breakdown voltage when the Hammer magnet is moving into the coil by virtue of the bullet system hitting a target. Remembering that the voltage induced on impact with a target will be such that the voltage at position (201) will be positive with respect to the voltage at position (203). Thus even though the Zener diode is reversed bias with respect to the Faraday EMF the Zener will have no effect whatsoever because the Faraday EMF will be much higher than the Zener diode reverse bias breakdown voltage and the system will function and there will be spark detonation when the bullet hits a target. What then is the purpose of the Zener diode (209) in FIG. 16? The purpose of the Zener diode (209) in FIG. 16 is significant albeit unobvious. When the bullet is travelling from left to right in FIG. 16 and when the bullet is accelerated from the rifle into the open air of its flight the flux through the coil will be changing with time and Faraday's Law will produce an electric field (213) in FIG. 16. The electric field will have the direction indicated as (213) in FIG. 16. The electric field (213) when the gun is fired and the electric field (213) while the bullet is in flight will be small compared to when the bullet hits its target because the Hammer Magnet is a lot farther away from the coil during takeoff from the rifle and during flight. Even though the electric field (213) will not be zero the Zener diode can be chosen so that the reverse breakdown voltage is greater than any voltage developed between position (201) and position (203) during takeoff from the rifle or during flight. The result is that the Zener diode with its reverse bias will keep an open circuit between position (201) and position (203) during flight takeoff from the rifle and during flight. The result is that during flight takeoff from the rifle and during flight it will be impossible for a voltage to appear between position (201) and position (203) in the circuit of FIG. 16 and generation of an EMP that could cause harm to the electronics of the person firing said bullet will not be possible. The presence of the Zener diode (209) will keep an open circuit between position (201) and position (203) during flight takeoff from the rifle and during flight.

Another adjustment to electronic parameters can be made to bring to light an optimum condition for generating said electromagnetic pulse. Referring to FIG. 10 the two wire or conductive ends (27) and (29) terminate into a spark gap capacitor (33) which has capacitance C in Farads. Further the said coil embedded in said fuselage has an inductance L. Referring to FIG. 7 and FIG. 10 for purposes of establishing a relationship between relevant parameters let us define the distance from the front of said hammer to the base of said coil as $L_{ES}$ since it is the length of the empty space within said fuselage before launch. The approximate speed of said bullet when it hits a target needs to be labeled so let us call that parameter $V_I$. The approximate time it takes said hammer to slide forward upon impact is $(L_{ES}/V_I)$. The inverse of that quantity is the quantity $(V_I/L_{ES})$ which defines a frequency. The inductance of said coil and the capacitance of said spark gap capacitor represent an LC circuit and the resonant frequency of that circuit is $(1/LC)^{1/2}$. In order to convert the kinetic energy of the motion of the hammer into the electromagnetic energy of the EMP and generate with the maximum efficiency we want this circuit to be operating at resonance. This means adjusting these parameters to obey the following equation $2\pi(V_I/L_{ES})=(1/LC)^{1/2}$. This will ensure the maximum conversion of kinetic energy into electromagnetic energy. For the design of said bullet system in FIG. 7 where there is a resistor antennae the circuit still has a capacitance which can be measured by known means and that capacitance can be put into the equation to get the optimum operating conditions. These conditions represent optimum conditions for result effective parameters in the system. It should be noted that the units of these result effective parameters are $V_I$ is in meters per second, and $L_{ES}$ is in meters, and L is in Henries, and C is in Farads.

CONCLUSIONS RAMIFICATIONS AND SCOPE

The bullet system employs internal electro-mechanical action which produces an electromagnetic pulse upon impact. The mechanical motion of the magnet generates a high electrical voltage on the coil by way of electromagnetic induction. The invention is broad with many more permutations than have been discussed and is not to be judged on the specification but rather on the scope of the claims that follow.

What is claimed is:

1. A bullet projectile for producing an electromagnetic pulse upon impact with a target comprising:

a cylindrical hollow fuselage, a solid cylindrical internal hammer, and a nose cone;

said cylindrical hollow fuselage having an inner diameter (ID) and outer diameter (OD) and length ($L_F$), and one end of said cylindrical hollow fuselage being closed, and the other end of said cylindrical hollow fuselage being open, and said closed end of said cylindrical hollow fuselage being faced towards the back end of said bullet projectile, and said open end of said fuselage being faced towards the front end of said bullet projectile;

said solid cylindrical internal hammer being inside said cylindrical hollow fuselage and having a length ($L_H$) less than length ($L_F$) and a diameter (D) which is between one mil and ten mils less than inner diameter (ID), and said solid cylindrical internal hammer being free to slide back and forth within said cylindrical hollow fuselage and, said solid cylindrical internal hammer being composed of a material with a permeant magnetic moment thereby said solid cylindrical internal hammer is a cylindrical permanent magnet, and said nose cone being attached to the open end of said fuselage;

said nose cone having a base and said base being the end of said nose cone which is in contact with the front open end of said cylindrical hollow fuselage, and the opposing end of said nose cone defining the front end of said nose cone which is the front end of said bullet projectile and, the position of said nose cone further defining the front end of said bullet projectile;

when said solid cylindrical internal hammer is positioned to be touching the closed end of said cylindrical hollow fuselage a volume of internal space exists between the front end of said solid cylindrical internal hammer and the base of said nose cone, and said volume of internal space being empty space within said fuselage, and within the solid walls of said cylindrical hollow fuselage is a conductive path forming a cylindrical coil, and wherein two ends of said conductive path are positioned in said empty space within said fuselage and are unconnected to form a spark gap therebetween; and whereupon and when said bullet projectile is accelerated from rest from a launching device, said solid cylindrical internal hammer is forced to slide to the rear of said bullet, and whereupon and when said bullet projectile strikes a target and undergoes deceleration said hammer is forced to slide towards the front of said bullet projectile, and as said solid cylindrical internal magnetic hammer slides forward towards the front of said bullet projectile it moves through the inside of said cylindrical coil causing a time changing magnetic flux through the coil thereby generating a voltage between said two ends of said conductive path causing a spark discharge therebetween, said spark discharge causing an electromagnetic pulse to emanate from said bullet projectile upon impact with a target.

2. The bullet projectile of claim 1 further including a spacer of a given thickness composed of a material which breaks easily when said bullet projectile makes impact with a target, and the thickness of said spacer being less than one tenth the length ($L_H$) of said hammer, and said spacer being firmly fitted between the front of said hammer and said nose cone and, and said spacer being in contact with the front end of said hammer, and said spacer having the purpose of holding said hammer in place against the back end of said fuselage for all times before said bullet makes impact with a target, and the energy required to break said spacer being less than the kinetic energy of said hammer when said bullet makes impact with a target.

3. The bullet projectile of claim 1 wherein one of said two ends is in the form of a sharp point and the other of said two ends is a flat conductive plate.

4. The bullet projectile of claim 1 wherein one of said two ends is in the form of a sharp point and the other of said two ends is also a sharp point.

5. The bullet projectile of claim 1 one of said two ends is a flat conductive plate, and the other of said two ends is a flat conductive plate.

6. The bullet projectile of claim 1 wherein said coil has a length (Lc), and the volume of internal space from the front of said coil to the base of said nose cone has a length ($L_{CN}$) wherein the length of said hammer ($L_H$) is greater than the length of said coil (Lc).

7. The bullet projectile of claim 1 wherein said cylindrical hollow fuselage is made of a material with a Young's modulus between 190 Gpa and 440 Gpa.

8. The bullet projectile of claim 1 wherein said solid cylindrical internal hammer is composed of a material with a permanent magnetic moment wherein a portion of said material further includes metal selected from the group of metals consisting of Lead, Uranium, Tungsten, Gold, Platinum, Mercury, or Iridium.

9. The bullet projectile of claim 1 wherein said fuselage is made of ceramic, and said nose cone is made of copper.

10. The bullet projectile of claim 1 wherein the front end of said nose cone is pointed.

11. The bullet projectile of claim 1 wherein the front end of said nose cone is rounded.

12. The bullet projectile of claim 1 wherein the front end of said nose cone is flat.

13. The bullet projectile of claim 1 wherein said nose cone is a compound structure consisting of a rounded flat base atop which sits a pointed cone.

14. The bullet projectile of claim 1 further including a second cylindrical hollow fuselage further surrounding said first mentioned cylindrical hollow fuselage, and said second cylindrical hollow fuselage serving to prevent plastic deformation of said first cylindrical hollow fuselage.

15. The bullet projectile of claim 1 wherein when said solid cylindrical internal hammer moves through said cylindrical coil in a direction from the rear end of said bullet projectile towards the front end of said bullet projectile, an electric field is generated in the conductive path which is everywhere tangent to the geometric circles formed by the cylindrical coil and said electric field serves to push current in the conductive path in a predetermined direction, and wherein the cylindrical coil further comprises a diode placed along the path of said conductive path wherein the bias of said diode allows current to flow in said predetermined direction.

16. The bullet of claim 1 wherein said cylindrical hollow fuselage is made of a material with a hardness between 1.8 and 50 Gpa.

17. The bullet projectile of claim 1 wherein when said solid cylindrical internal hammer moves through said cylindrical coil in a direction from the rear end of said bullet projectile towards the front end of said bullet projectile, an electric field is generated in the conductive path which is everywhere tangent to the geometric circles formed by the cylindrical coil and said electric field serves to push current in the conductive path in a predetermined direction, and wherein the cylindrical coil further includes a Zener diode oriented so that its forward bias direction is opposite said predetermined direction.

* * * * *